US005619164A

United States Patent [19]

Tomishima

[11] Patent Number: 5,619,164

[45] Date of Patent: Apr. 8, 1997

[54] PSEUDO GROUND LINE VOLTAGE REGULATOR

[75] Inventor: Shigeki Tomishima, Hyogo, Japan

[73] Assignee: Mitsubishi Denki Kabushiki Kaisha, Tokyo, Japan

[21] Appl. No.: 524,928

[22] Filed: Sep. 8, 1995

[30] Foreign Application Priority Data

Nov. 25, 1994 [JP] Japan ..... 6-291078

[51] Int. Cl.[6] ..... G05F 1/10

[52] U.S. Cl. ..... 327/541; 327/543; 327/80; 323/315

[58] Field of Search ..... 327/53, 54, 80, 327/81, 87, 323, 332, 538, 540, 541, 543, 544, 546; 323/315; 365/228, 203, 189.11

[56] References Cited

U.S. PATENT DOCUMENTS

| | | | |
|---|---|---|---|
| 4,399,399 | 8/1983 | Joseph | 323/315 |
| 5,087,891 | 2/1992 | Cytera | 330/288 |
| 5,245,273 | 8/1993 | Greaves et al. | 323/313 |
| 5,481,179 | 1/1996 | Keeth | 323/315 |
| 5,521,490 | 5/1996 | Manohar | 323/315 |

FOREIGN PATENT DOCUMENTS

| | | |
|---|---|---|
| 55-53709 | 4/1980 | Japan . |
| WO86/07183 | 12/1986 | WIPO . |

*Primary Examiner*—Timothy P. Callahan
*Assistant Examiner*—Jung Ho Kim
*Attorney, Agent, or Firm*—Lowe, Price, LeBlanc & Becker

[57] ABSTRACT

An MOS transistor 3 conducts when a potential of a pseudo GND line 33 exceeds a threshold Vth3 of MOS transistor 3. A current mirror circuit CM1 supplies a current Ib which is α times a current Ia flowing through MOS transistor 3. A current mirror CM2 lets a current Ib according to the output current Ib from the current mirror circuit CM1 flow out from the pseudo GND line 33 to a ground line 32. Without providing a separate reference potential generating circuit 35, the potential of the pseudo GND line 33 can be maintained to a constant value.

7 Claims, 7 Drawing Sheets

PSEUDO GROUND LINE VOLTAGE REGULATOR

BACKGROUND OF THE INVENTION

1. Field of the Invention

The present invention relates to a semiconductor device, and more particularly to a semiconductor device having an internal ground potential boosted from an external ground potential.

2. Description of the Background Art

FIG. 6 illustrates a circuit diagram showing the structure of the main portion of a dynamic random access memory (DRAM). Referring to FIG. 6, the DRAM includes a memory cell MC connected to a bit line BL and to a word line WL, and memory cell MC includes a capacitor Cs and a transistor Q. When data is written to memory cell MC, according to the data, bit line BL is applied with "H" (high) level (power supply potential Vcc) or "L" (low) level (ground potential GND) and word line WL is applied with "H" level so that transistor Q is rendered conductive, thereby charging capacitor Cs. When reading data from memory cell MC, after rendering bit line BL floating by applying a predetermined potential (for example, Vcc/2) to bit line BL, word line WL is changed to "H" level so that transistor Q is rendered conductive, and a slight change in potential of bit line BL is amplified to "H" or "L" level for reading data. Thus, in a DRAM, memory cell MC can be rewritten and data written in the memory cell MC can be read freely.

However, for a conventional DRAM, since the "L" level of amplitude of bit line BL is the ground potential GND which is the same as the "L" level of an unselected word line WL, a sub-threshold leak current Is which leaks from capacitor Cs into bit line BL via transistor Q is relatively large. Therefore, the conventional DRAM has a problem that data written into memory cell MC will disappear in a relatively short period of time.

Accordingly, the inventors of the present invention have proposed pseudo GND method in which the "L" level of bit line BL is adapted to be a pseudo GND potential BSG, which is higher than the "L" level of word line WL, that is, the ground potential GND.

FIG. 7 illustrates a partially omitted circuit diagram of a DRAM to which the pseudo GND method is applied. Referring to FIG. 7, the DRAM includes a power supply line 31 through which the power supply potential Vcc is externally provided, a ground line 32 through which the ground potential GND is externally provided and a pseudo GND line 33 the level of which is maintained to the pseudo GND potential BSG, which is higher than the ground potential GND.

Furthermore, the DRAM includes an internal circuit 34, a reference potential generating circuit 35, a differential amplifier 36 and an n-channel MOS transistor 37. The internal circuit 34 is a circuit associated with determining the potential of bit line BL such as a charging and discharging circuit (a sense amplifier circuit) for a bit line or a Vcc/2 generating circuit, and is not the entire circuit within the chip (especially, a word line drive circuit is not included in the internal circuit 45). For a conventional DRAM, the internal circuit 34 is connected between the power supply line 31 and the ground line 32. For the DRAM of the pseudo GND method, the internal circuit is connected between the power supply line 31 and the pseudo GND line 33.

The reference potential generating circuit 35 includes a constant current source 38 and a resistor 39 which are connected in series between the power supply line 31 and the ground line 32, as shown in FIG. 8. When a constant amount of current is supplied from the constant current source 38, a reference voltage Vref, which is of the value of the current multiplied by the resistance of resistor 39, is output at the connecting node N38 between the constant current source 38 and resistor 39.

Referring to FIG. 9, the differential amplifier 36 includes p-channel MOS transistors 40, 41 and n-channel MOS transistors 42, 43. MOS transistors 40, 42 are connected in series between the power supply line 31 and the ground line 32. M0S transistors 41, 43 are connected in series and they are also connected in parallel with MOS transistors 40, 42. The gates of MOS transistors 40, 41 are connected to a connecting node N40 of MOS transistors 40 and 42. The gate of MOS transistor 42 is connected to the pseudo GND line 33. The gate of MOS transistor 43 is supplied with the reference potential Vref from the reference potential generating circuit 35. A connecting node N41 of MOS transistors 41 and 43 is the output node of the differential amplifier 36.

Through MOS transistor 42, a current Id flow according to the potential of the pseudo GND line 33. Through MOS transistor 43, a constant amount of current Ie flow according to the reference potential Vref. Since MOS transistors 42 and 40 are connected in series and MOS transistors 40 and 41 configure a current mirror circuit, the same current Id flow through the three MOS transistors 40, 41, 42.

Therefore, when the potential of the pseudo GND line 33 is higher than the reference potential Vref and current Id is larger than current Ie, then subtracting current Ie from Id gives a positive value and node N41 will be pulled up to "H" level. On the other hand, when the potential of the pseudo GND line 33 is lower than the reference potential Vref and current Id is smaller than current Ie, subtracting current Ie from Id gives a negative value and node N41 will be pulled down to "L" level.

Furthermore, n-channel MOS transistor 37 is connected between the pseudo GND line 33 and the ground line 32, and its gate receives the output Vout of the differential amplifier 36.

The operation of the circuit shown in FIG. 7 will now be described. The current supplied from the power supply line 31 to the internal circuit 34 drives the internal circuit 34 and then flow into the pseudo GND line 33. When the potential of the pseudo GND line 33 goes higher than the reference potential Vref, the differential amplifier 36 will output "H" level so that MOS transistor 37 can be conducted. On the other hand, when the potential of the pseudo GND line 33 goes lower than the reference potential Vref, the differential amplifier 36 will output "L" level so that MOS transistor 37 cannot be conducted. Thus, the potential of the pseudo GND line 33 is maintained to the pseudo GND potential BSG, which is nearly equal to the reference potential Vref.

FIG. 10 is a partially omitted circuit diagram illustrating the configuration of another DRAM to which the pseudo GND method is applied. Referring to FIG. 10, this DRAM differs from the DRAMs shown in FIGS. 7–9 in that an n-channel MOS transistor 44 is connected between the sources of MOS transistors 42, 43 in the differential amplifier 36 and the ground line 32. The gate of n-channel MOS transistor 44 receives a signal $\phi s$ for activating the internal circuit shown in FIG. 7.

During a stand-by period of the internal circuit 34, the activating signal $\phi s$ is at "L" level and MOS transistor 44 may be shut down. Therefore, the differential amplifier 36 is deactivated. During an active period of the internal circuit 34, the activating signal ϕs is at "H" level and MOS transistor 44 may be conducted. Therefore, the differential amplifier 36 is activated. The operation of this DRAM during the active period is the same as those of the DRAMs shown in FIGS. 7–9.

In this DRAM, the differential amplifier 36 can be deactivated during a stand-by period of the internal circuit 34, thereby reducing power consumption.

FIG. 11 is a partially omitted block diagram of a circuit illustrating the configuration of still another DRAM to which the pseudo GND method is applied. Referring to FIG. 11, this DRAM differs from the DRAM shown in FIG. 7 in that a diode 45 is connected between the pseudo GND line 33 and the drain of n-channel MOS transistor 37.

For this DRAM, the difference of potential between the pseudo GND line 33 and the ground line 32 will never be smaller than a threshold voltage of diode 45. Thus, the potential drop of the GND line 33 due to a delay in the response by the differential amplifier 36 can be prevented.

FIG. 12 is a partially omitted block diagram of a circuit illustrating the configuration of still another DRAM to which the pseudo GND method is applied. Referring to FIG. 12, this DRAM differs from the DRAM shown in FIG. 11 in that a decoupling capacitor 46 is connected in parallel with n-channel MOS transistor 37.

For this DRAM, capacitor 46 can prevent the potential of the pseudo GND line 33 from rapidly changing, so that a stable pseudo GND potential BSG can be obtained.

FIG. 13 is a partially omitted block diagram of a circuit illustrating the configuration of still another DRAM to which the pseudo GND method is applied. Referring to FIG. 13, this DRAM differs from the DRAM shown in FIG. 7 in that n-channel MOS transistors 47, 48 and a sustain circuit 49 are further provided in the DRAM.

The drain and gate of n-channel MOS transistor 47 are connected to the pseudo GND line 33, and its source is connected to the ground line 32. During a stand-by period of the internal circuit 34, n-channel MOS transistor 47 will maintain the pseudo GND line 33 to a threshold voltage Vth of n-channel MOS transistor 47.

N-channel MOS transistor 48 is connected between the pseudo GND line 33 and the ground line 32, and its gate receives a signal ϕs which is synchronized with a sense amplifier-activating signal. The signal ϕs will go to "H" level at the time the sense amplifier operates where a large amount of current flows into the pseudo GND line 33 from the internal circuit 34 including the sense amplifier, so that n-channel MOS transistor 48 is rendered conductive, thereby flowing the large amount of current from the internal circuit out into the ground line 32.

The sustain circuit 49 includes an oscillator 50 and a pumping circuit 51. The pumping circuit 51 intermittently supplies electric charges to the pseudo GND line 33 in response to an oscillation signal from the oscillator 50. Accordingly, the potential of the pseudo GND line 33, even if going lower than the pseudo GND potential BSG, can be quickly returned to BSG.

In this DRAM, the combination of these components allow for a more stable pseudo GND potential BSG.

For the DRAMs shown in FIGS. 7–13 to which the pseudo GND method is applied, however, the reference potential generating circuit must be included and this causes problems such as a more complex circuit configuration and a larger amount of power consumption.

SUMMARY OF THE INVENTION

Therefore, an objective of the present invention is to provide a semiconductor which has a simplified configuration and consumes a small amount of current.

Simply speaking, in the semiconductor according to the present invention, a first transistor conducts when potential of a line of the internal ground potential exceeds a threshold value of a first transistor and this allows a current which is amplified from the current flowing through the first transistor by first and second current mirror circuits to be flown out from the line of the internal ground potential to a line of the external ground potential. Therefore, different from the conventional example, the potential of the line of the internal ground potential can be maintained to the threshold of the first transistor without providing a separate reference potential generating circuit, allowing for a more simplified circuit configuration and a lower power consumption.

Furthermore, a circuit for maintaining the potential of the internal ground line to the threshold value of the first transistor can be readily configured, if the first transistor is connected between a first node and the line of the external ground potential, the first current mirror circuit includes a third transistor connected between a power supply potential and the first node and a fourth transistor connected between the power supply potential and a second node, and the second current mirror circuit includes the fourth transistor connected between the second node and the line of the external ground potential and a fifth transistor connected between the line of the internal ground potential and that of the external ground potential.

Preferably, a control circuit is further provided for deactivating at least one of the first and second current mirror circuits in response to deactivation of the internal circuit. This allows for a further reduction in power consumption.

Furthermore, if the control circuit includes a first connecting circuit connected between the second electrodes of the first and fourth transistors and the line of the external ground potential, the first current mirror circuit will be deactivated when the first connecting circuit is shut down.

Furthermore, if the control circuit includes a second connecting circuit connected between the line of the power supply potential and the first electrodes of the second and third transistors, the first current mirror circuit will be deactivated when the second connecting circuit is shut down.

Furthermore, if the control circuit includes a third connecting circuit connected between the first electrode of the first transistor and the second electrode of the second transistor and a fourth connecting circuit connected between the first electrode of the fourth transistor and the second electrode of the third transistor, the first current mirror circuit will be deactivated when the third and fourth connecting circuits are shut down.

Furthermore, if the control circuit includes a fifth connecting circuit between the input electrodes of the fourth and fifth transistors and the line of the external ground potential, the second current mirror circuit will be deactivated when the fifth connecting circuit conducts.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

[First Embodiment]

Figure 1:
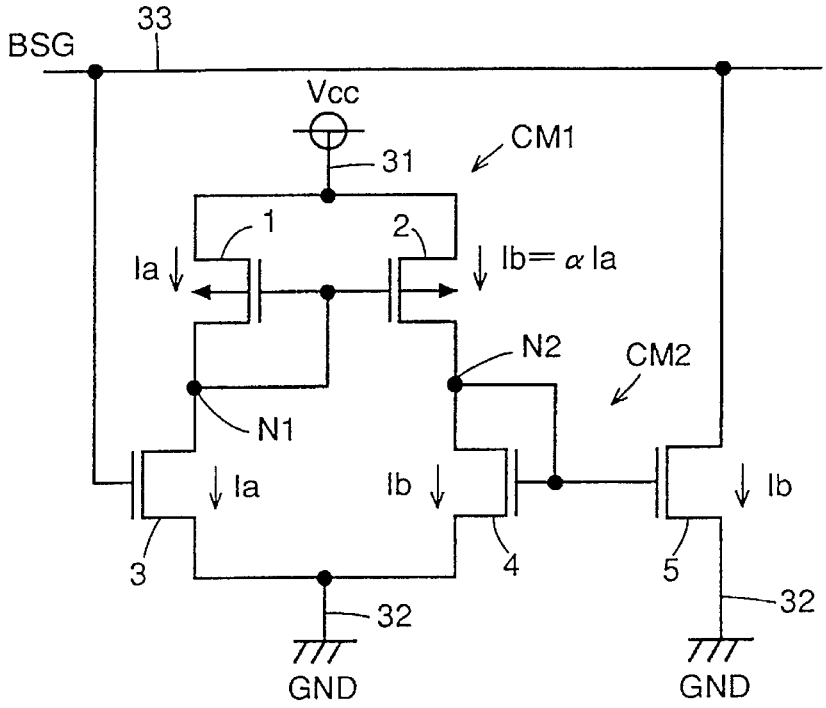
FIG. 1 is a partially omitted block diagram of a circuit illustrating the configuration of a DRAM in accordance with a first embodiment of the present invention.
Figure 7:
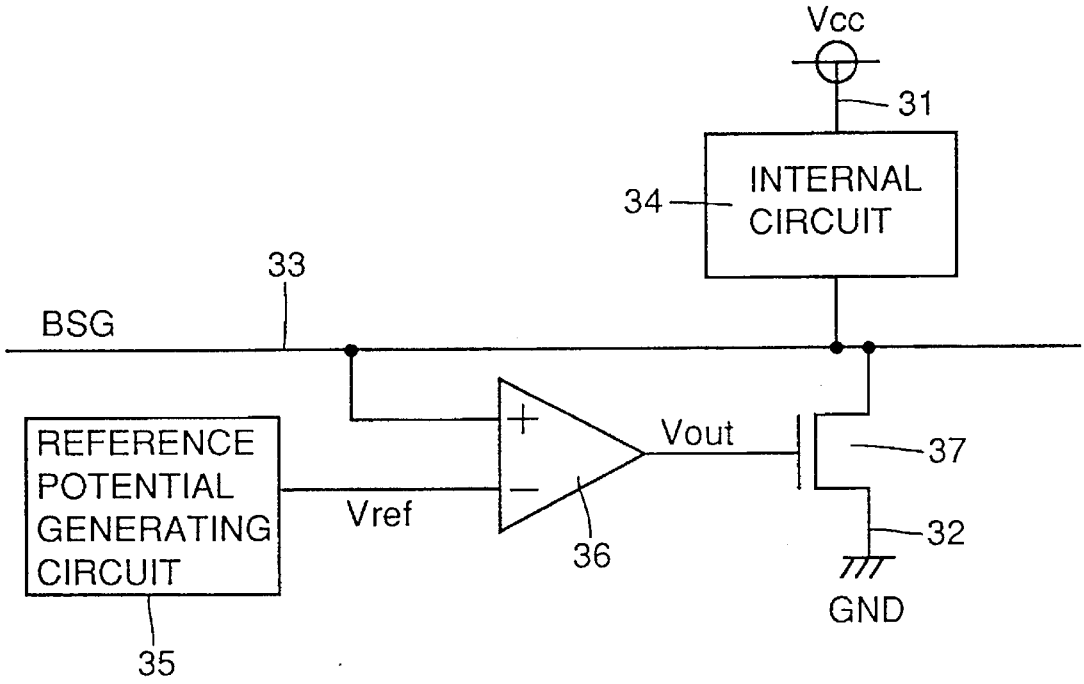
FIG. 7 PRIOR ART
FIG. 7 is a partially omitted block diagram of a circuit showing the configuration of a DRAM to which the pseudo GND method is applied.
Figure 8:
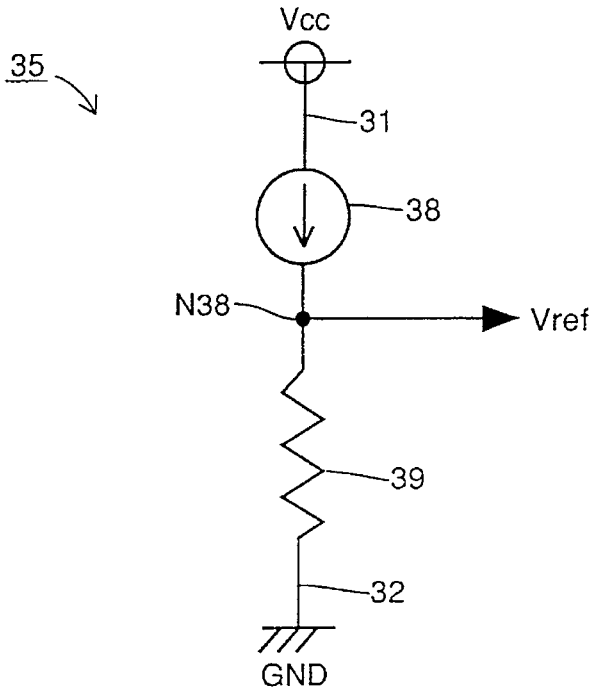
FIG. 8 PRIOR ART
FIG. 8 is a circuit diagram illustrating the configuration of the reference potential generating circuit in the DRAM shown in FIG. 7.
Figure 9:
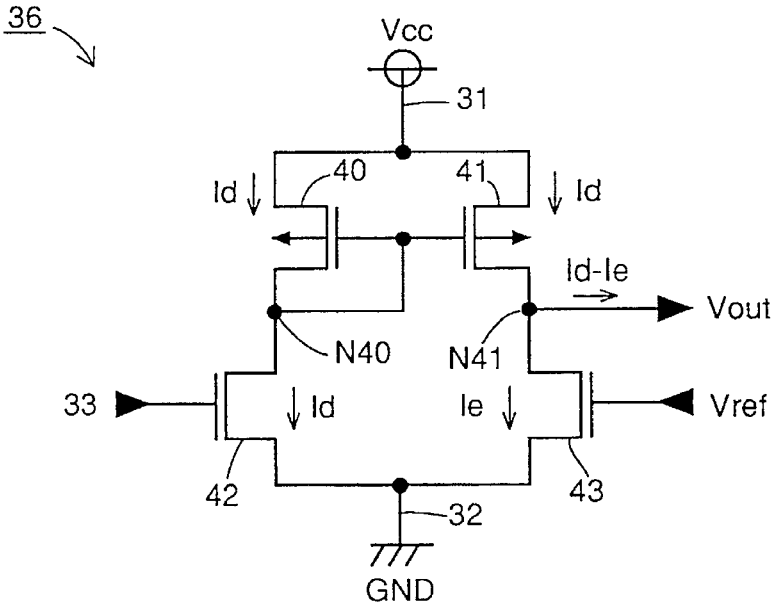
FIG. 9 PRIOR ART
FIG. 9 is a circuit diagram illustrating the configuration of the differential amplifier 36 in the DRAM shown in FIG. 7.
Figure 10:
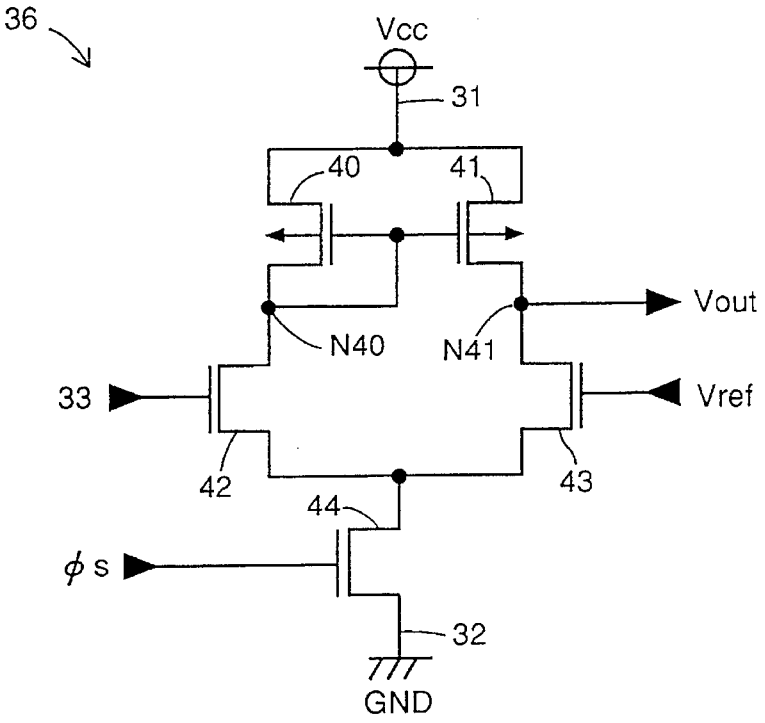
FIG. 10 PRIOR ART
FIG. 10 is a partially omitted block diagram of a circuit showing the configuration of another DRAM to which the pseudo GND method is applied.
Figure 11:
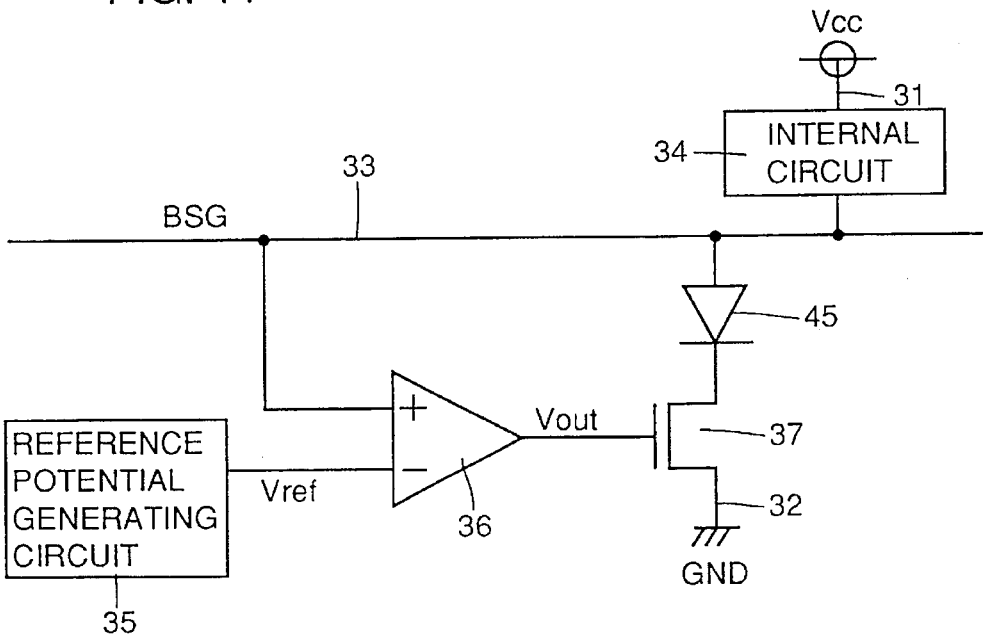
FIG. 11 PRIOR ART
FIG. 11 is a partially omitted block diagram of a circuit showing the configuration of still another DRAM to which the pseudo GND method is applied.
Figure 12:
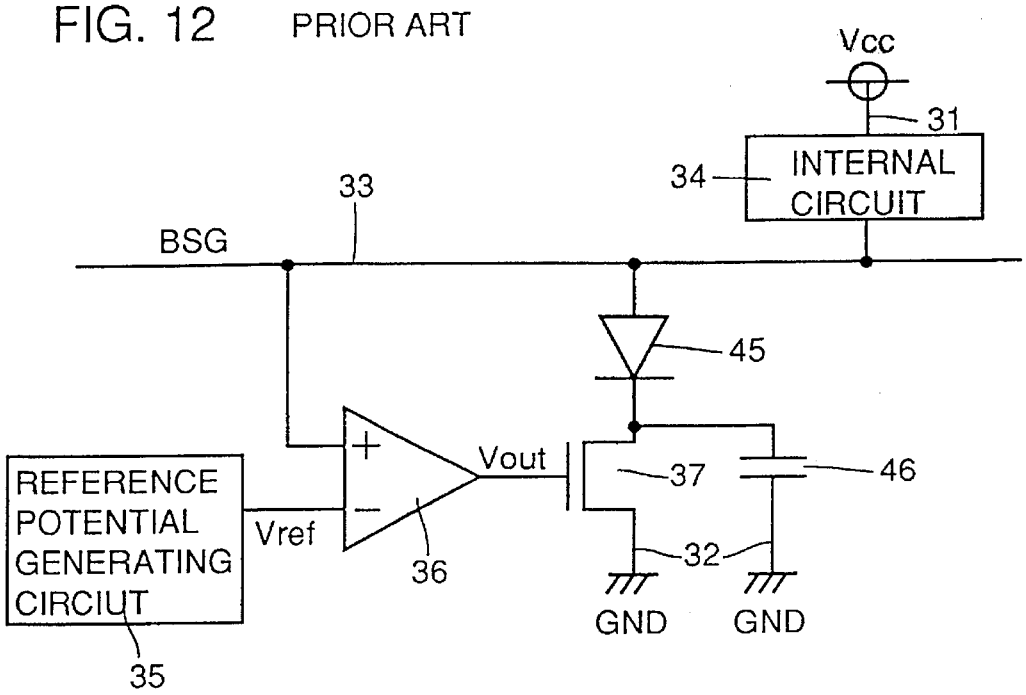
FIG. 12 PRIOR ART
FIG. 12 is a partially omitted block diagram of a circuit showing the configuration of still another DRAM to which the pseudo GND method is applied.
Figure 13:
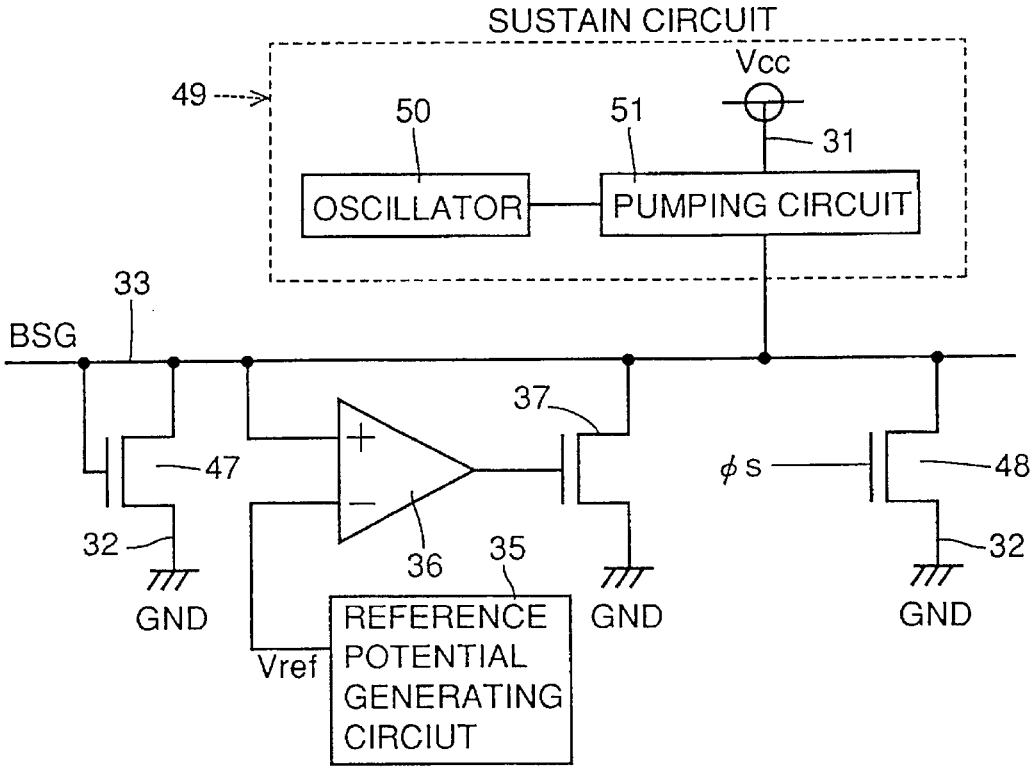
FIG. 13 PRIOR ART
FIG. 13 is a partially omitted block diagram of a circuit showing the configuration of still another DRAM to which the pseudo GND method is applied.

FIG. 1 is a partially omitted circuit diagram showing the configuration of a DRAM according to a first embodiment of the present invention. Referring to FIG. 1, the DRAM, as with the DRAMs shown in FIGS. 7–13, includes a power supply line 31, a ground line 32 which is supplied externally with a ground potential GND and a pseudo GND line 33 which is maintained to a pseudo GND potential BSG, which is higher than the ground potential GND. Although it is not shown, an external circuit 34 is connected to the pseudo GND line 33, as is the same with the DRAM shown in FIG. 7.

The DRAM also includes p-channel MOS transistors 1, 2 and n-channel MOS transistors 3–5. The gate, drain and source of n-channel MOS transistor 3 are connected to the pseudo GND line 33, a node N1 and the ground line 32, respectively.

A threshold value Vth3 of n-channel MOS transistor 3 is set to the same value as, or a slightly higher value than, the pseudo GND potential BSG. Accordingly, when the potential of the pseudo GND line 33 goes higher than the threshold Vth3 of n-channel MOS transistor 3, n-channel M0S transistor 3 will conduct. A current flowing through n-channel MOS transistor 3 is referred to as Ia hereinafter.

The source of p-channel MOS transistor 1 is connected to the power supply line 31 and its drain and gate are connected to node N1. The source, drain and gate of p-channel MOS transistor 2 are connected to the power supply line 31, node N2 and node N1, respectively. Therefore, p-channel MOS transistors 1 and 2 configure a current mirror circuit CM1. The size of p-channel MOS transistor 2 is set to $\alpha$ times the size of p-channel MOS transistor 1, wherein $\alpha \geqq 1$.

As p-channel MOS transistor 1 is connected in series with n-channel MOS transistor 3, the current of the same value as the current Ia flowing through n-channel MOS transistor 3 will flow through p-channel MOS transistor 1. Since p-channel MOS transistors 1 and 2 configure a current mirror circuit and the size of p-channel MOS transistor 2 is $\alpha$ times that of p-channel M0S transistor 1, a current Ib which is equal to $\alpha$Ia, i.e., $\alpha$ times the current Ia flowing through p-channel MOS transistor 1, flows through p-channel MOS transistor 2.

The drain and gate of n-channel MOS transistor 4 are connected to node N2 and its source is connected to the ground line 32. The drain, source and gate of n-channel MOS transistor 5 are connected to the pseudo GND line 33, the ground line 32 and node N2, respectively. Therefore, n-channel MOS transistors 4 and 5 configure a current mirror circuit CM2. The sizes of n-channel MOS transistors 4 and 5 are set to, for example, the same value.

As n-channel MOS transistor 4 is connected in series with p-channel MOS transistor 2, the same current value as the current Ib flowing through p-channel M0S transistor 2 flows through n-channel MOS transistor 4. Since n-channel MOS transistors 4 and 5 configure a current mirror circuit and the size of n-channel MOS transistor 5 is the same as that of n-channel MOS transistor 4, the current of the same value as the current Ib flowing through n-channel MOS transistor 4 flows through n-channel MOS transistor 5.

The operation of the circuit shown in FIG. 1 will now be described. When the potential of the pseudo GND line 33 is lower than the threshold value Vth3 of n-channel MOS transistor 3, n-channel M0S transistors 3 will be shut down and no current flows through n-channel MOS transistors 3. Accordingly, no current flows through the other n-channel MOS transistors 1, 2, 4, 5, either, rendering the pseudo GND line floating.

However, when a current flows from the internal circuit 34 (not shown) into the pseudo GND line 33 due to a sensing operation and a column-associated operation and the potential of the pseudo GND line 33 rises and exceeds the threshold value Vth3 of n-channel MOS transistor 3, n-channel MOS transistor 3 will conduct and the current Ia begins to flow through n-channel M0S transistor 3 and, responsively, through MOS transistors 1, 2, 4, 5.

Specifically speaking, when the current Ia begins to flow through n-channel MOS transistor 3, the potential of node 1, that is, the potentials of the gates of p-channel MOS transistors 1, 2 will begin to fall. Then, if the potential of node N1 goes lower than the power supply potential Vcc by the values of the threshold voltages Vth1, Vth2 of p-channel MOS transistors 1, 2 or more, p-channel MOS transistors 1, 2 will conduct, thereby starting to charge nodes N1 and N2. As described above, current Ib which is equal to $\alpha$Ia, i.e. $\alpha$ times the current Ia which flows through p-channel MOS transistor 1, flows through p-channel MOS transistor 2, so that the potential of node N2, that is, the potentials of the gates of n-channel MOS transistors 4, 5 will change more greatly and rapidly than the potential of node N1. When the potentials of n-channel MOS transistors 4, 5 go higher than the threshold values Vth4 and Vth5 of n-channel MOS transistors 4, 5, n-channel MOS transistors 4, 5 conduct, thereby attempting to lower the potential of the pseudo GND line 33.

When the potential of the pseudo GND line 33 goes lower than the threshold value Vth3 of n-channel MOS transistor 3, n-channel MOS transistor 3 is shut down and the current Ia does not flow through n-channel MOS transistor 3. Node 1 is charged to a potential which is lower than the power supply potential Vcc by the threshold voltage Vth1 of p-channel MOS transistor 1, and p-channel MOS transistors 1, 2 are shut down. Responsively, node N2 is not charged and its potential falls, causing n-channel MOS transistors 4, 5 to be shut down. By repeating such a process, the potential of the pseudo GND line 33 is maintained to the pseudo GND potential BSG.

In this embodiment, the potential of the pseudo GND line 33 can be maintained to the pseudo GND potential BSG without using reference potential Vref as shown in the circuits in FIGS. 7–13. Therefore, separate reference potential generating circuit 35 is not necessary, and the reduction in chip size as well as in power consumption can be achieved.

[Second Embodiment]

Figure 2:
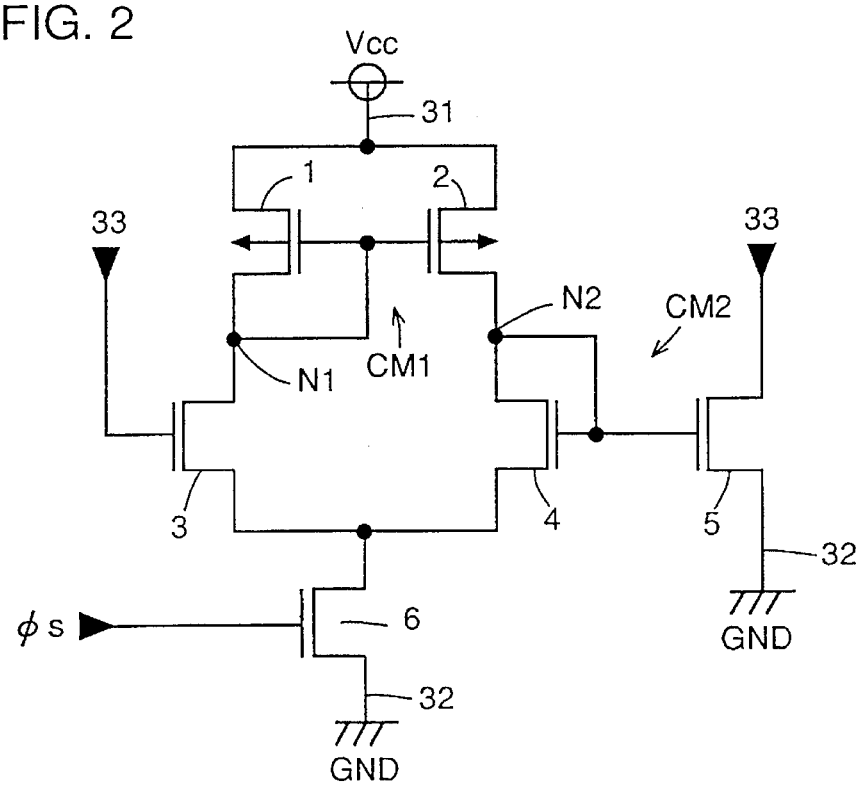
FIG. 2 is a partially omitted block diagram of a circuit illustrating the configuration of a DRAM in accordance with a second embodiment of the present invention.

FIG. 2 is a partially omitted circuit diagram showing the configuration of a DRAM according to a second embodiment of the present invention. Referring to FIG. 2, the DRAM differs from the DRAM shown in FIG. 1 in that an n-channel MOS transistor 6 is connected between the sources of n-channel MOS transistors 3, 4 and the ground line 32. The gate of n-channel MOS transistor 6 receives an activating signal ϕs. The activating signal ϕs is a signal which goes to "H" level during an active period of the internal circuit 34 shown in FIG. 7 and to "L" level during its stand-by period.

During an active period of the internal circuit 34, n-channel MOS transistor 6 conducts, and the circuit shown in FIG. 2 operates in the same manner as the circuit described with reference to FIG. 1. During a stand-by period of the internal circuit 34, n-channel MOS transistor 6 is shut down and the circuit shown in FIG. 2 is deactivated.

In this embodiment, since a circuit for generating the pseudo GND potential BSG is deactivated during a stand-by period of the internal circuit 34, a further reduction in power consumption will be achieved in addition to the effect of the first embodiment.

[Third Embodiment]

Figure 3:
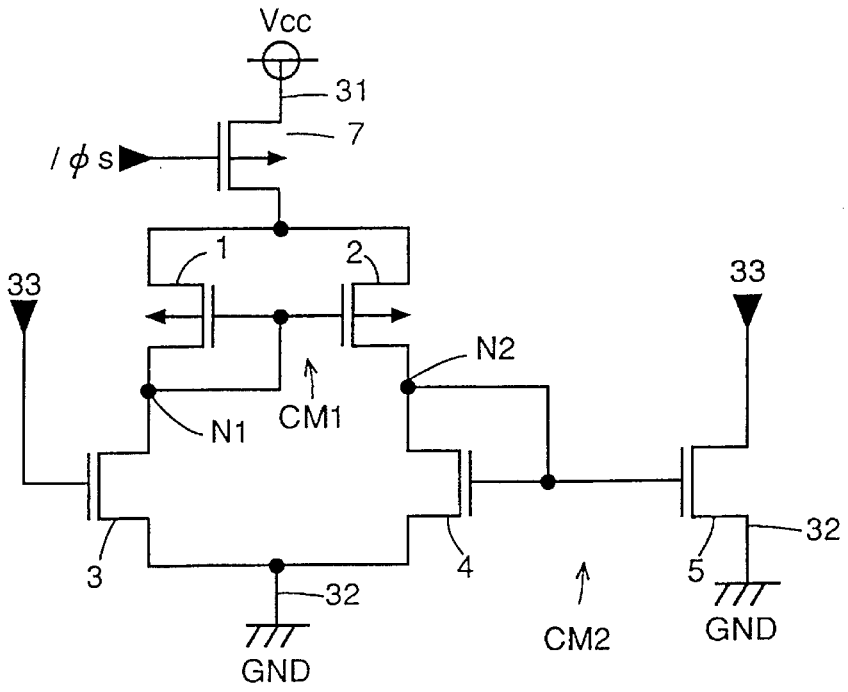
FIG. 3 is a partially omitted block diagram of a circuit illustrating the configuration of a DRAM in accordance with a third embodiment of the present invention.

FIG. 3 is a partially omitted circuit diagram showing the configuration of a DRAM in accordance with a third embodiment of the present invention. Referring to FIG. 3, the DRAM differs from the DRAM shown in FIG. 1 in that a p-channel MOS transistor 7 is connected between the power supply line 31 and the 'sources of p-channel MOS transistors 1, 2. The gate of p-channel MOS transistor 7 receives a signal/ϕs which is the inverted signal of the activating signal ϕs described above.

During an active period of the internal circuit 34, p-channel MOS transistor 7 conducts, and the circuit shown in FIG. 3 operates in the same manner as the circuit described with reference to FIG. 1. During a stand-by period of the internal circuit 34, p-channel MOS transistor 7 is shut down and the circuit shown in FIG. 3 is deactivated.

Also in this embodiment, the same effect as described with reference to the second embodiment can be obtained.

[Fourth Embodiment]

Figure 4:
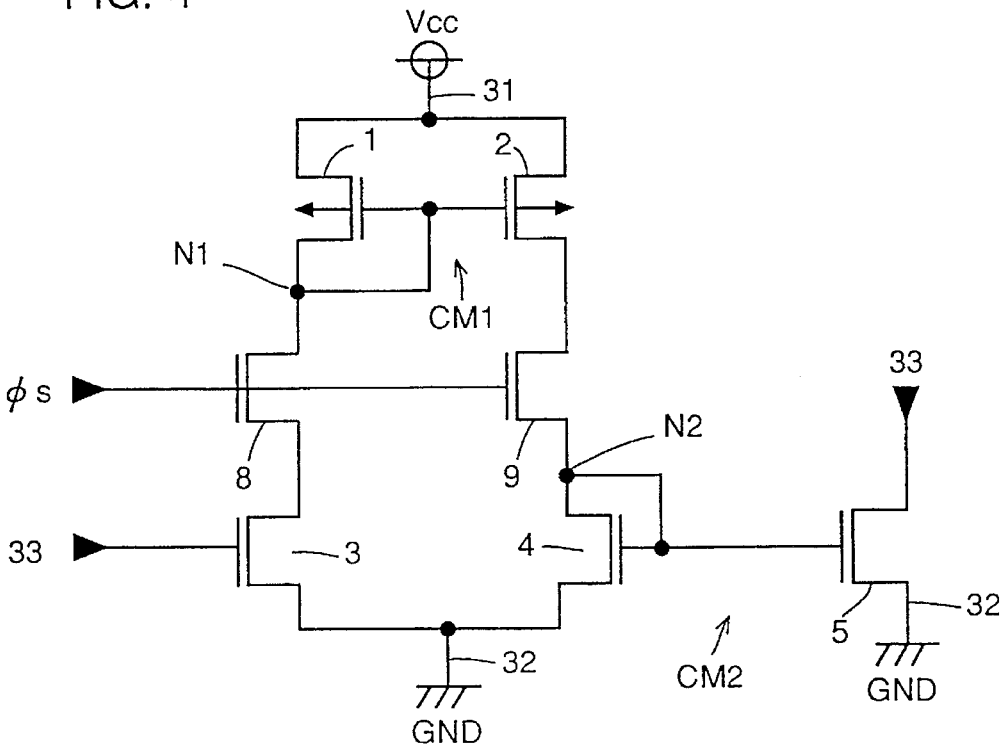
FIG. 4 is a partially omitted block diagram of a circuit illustrating the configuration of a DRAM in accordance with a fourth embodiment of the present invention.

FIG. 4 is a partially omitted circuit diagram showing the configuration of a DRAM according to a fourth embodiment of the present invention. Referring to FIG. 4, the DRAM differs from the DRAM shown in FIG. 1 in that an n-channel MOS transistor 8 is connected between the drain of p-channel MOS transistor 1 and the drain of n-channel MOS transistor 3 and that an n-channel MOS transistor 9 is connected between the drain of p-channel MOS transistor 2 and the drain of n-channel MOS transistor 4. n-channel MOS transistors 8, 9 both receive the activating signal ϕs.

During an active period of the internal circuit 34, n-channel MOS transistors 8, 9 are conducting and the circuit shown in FIG. 4 operates in the same manner as the circuit described with reference to FIG. 1. During a stand-by period of the internal circuit 34, n-channel MOS transistors 8, 9 are shut down and the circuit shown in FIG. 4 is deactivated.

In this embodiment, the same effects as described with reference to the second embodiment can be obtained.

[Fifth Embodiment]

Figure 5:
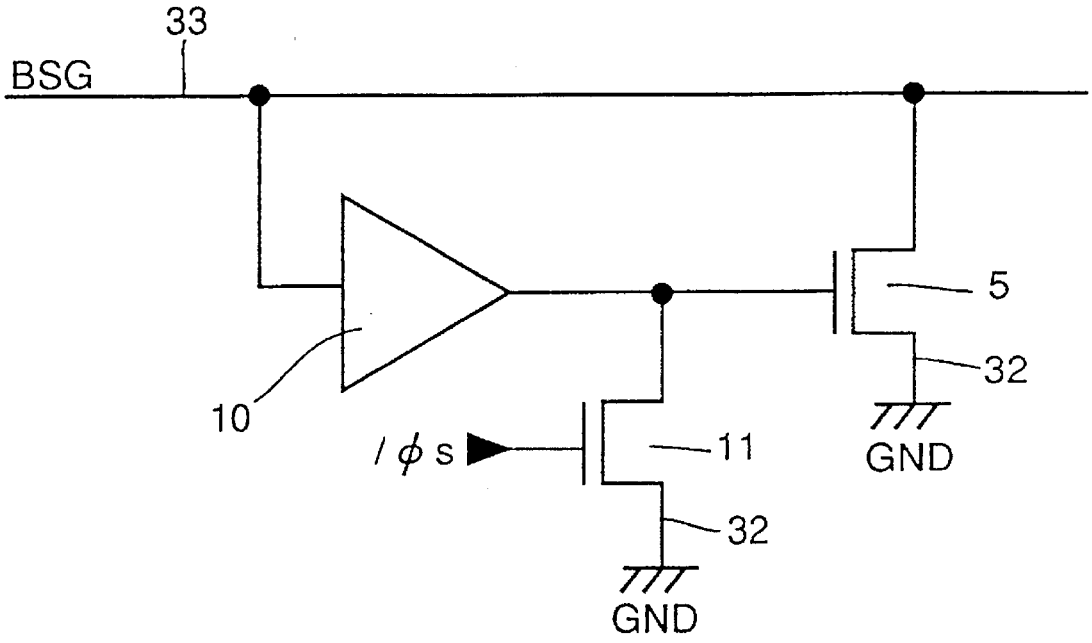
FIG. 5 is a partially omitted block diagram of a circuit illustrating the configuration of a DRAM in accordance with a fifth embodiment of the present invention.
Figure 6:
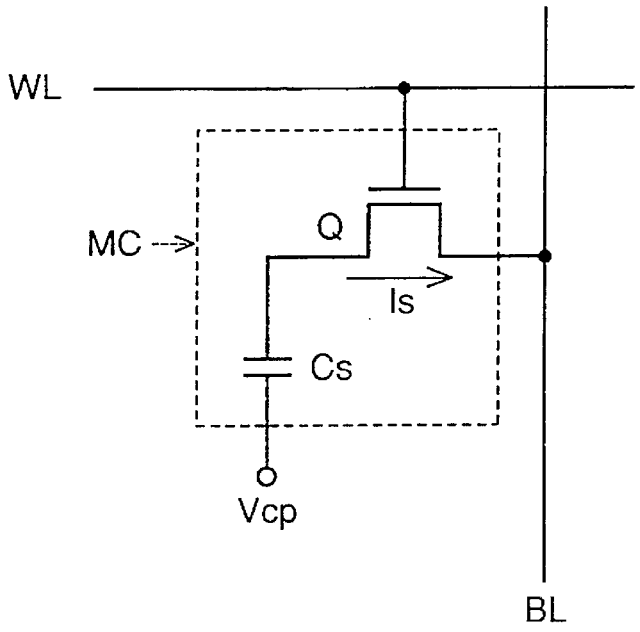
FIG. 6 PRIOR ART
FIG. 6 is a circuit diagram illustrating the configuration of the main portion of a DRAM.

FIG. 5 is a partially omitted circuit diagram showing the configuration of a DRAM of a fifth embodiment of the present invention. Referring to FIG. 5, a comparing circuit 10 is configured with MOS transistors 1–4 in the circuit shown in FIG. 1. Therefore, the DRAM differs from the DRAM shown in FIG. 1 in that an n-channel MOS transistor 11 is connected between n-channel MOS transistor 5 and the ground line 32. n-channel MOS transistor 11 receives/ϕs which is the inverted signal of the activating signal ϕs.

During an active period of the internal circuit 34, n-channel MOS transistor 11 is shut down and the circuit shown in FIG. 5 operates in the same manner as the circuit shown in FIG. 1. During a stand-by period of the internal circuit 34, n-channel MOS transistor 11 is conducting so that the gate of n-channel MOS transistor 5 is forced to be grounded and n-channel MOS transistor 5 is shut down. Thus, the pseudo GND line 33 is rendered floating.

In this embodiment, since the gate of n-channel MOS transistor 5 is grounded during a stand-by period of the internal circuit 34, n-channel MOS transistor 5 can be completely shut down. Accordingly, a potential fall of the pseudo GND line 33 due to a subleak of n-channel MOS transistor 5 can be prevented and a stable pseudo GND potential BSG can be obtained.

Furthermore, this embodiment can be combined with any of the second, third and fourth embodiments.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A semiconductor device having an internal ground potential boosted from an external ground potential comprising:

an internal circuit connected between a line of a power supply potential and a line of said internal ground potential for performing a predetermined operation;

a first transistor having its input electrode connected to the line of said internal ground potential, and rendered conductive when the voltage at its input electrode exceeds its threshold voltage;

a first current mirror circuit for supplying a current which is α times a current flowing through said first transistor, wherein α is a constant; and a second current mirror circuit for letting a current dependent upon the output current from said first current mirror circuit flow out from the line of said internal ground potential to a line of said external ground potential.

2. A semiconductor according to claim 1, wherein:

said first transistor is of a first conductivity type and has its first electrode connected to a first node and its second electrode connected to the line of said external ground potential;

said first current mirror circuit includes second and third transistors of a second conductivity type, wherein said second and third transistors have their input electrodes both connected to said first node and their first electrodes both connected to the line of said power potential, and one of said second and third transistors has its second electrode connected to said first node and the other has its second electrode connected to a second node; and said second current mirror circuit includes fourth and fifth transistors in the first conductivity type, wherein said fourth and fifth transistors have their input electrodes both connected to said second node, one of said fourth and fifth transistors has its first electrode connected to said second node and the other has its first electrode connected to the line of said internal ground potential, and said fourth and fifth transistors have their second electrodes both connected to the line of said external ground potential.

3. A semiconductor device according to claim 2, further comprising a control circuit for deactivating at least one of said first and second current mirror circuits in response to deactivation of said internal circuit.

4. A semiconductor device according to claim 3, wherein said control circuit includes a first connecting circuit connected between the second electrodes of said first and fourth transistors and the line of said external ground potential and being shut down in response to deactivation of said internal circuit.

5. A semiconductor device according to claim 3, wherein said control circuit includes a second connecting circuit connected between the line of said power supply potential and the first electrodes of said second and third transistors and being shut down in response to deactivation of said internal circuit.

6. A semiconductor device according to claim 3, wherein said control circuit includes:

a third connecting circuit connected between the first electrode of said first transistor and the second electrode of said second transistor and being shut down in response to deactivation of said internal circuit; and a fourth connecting circuit connected between the first electrode of said fourth transistor and the second electrode of said third transistor and being shut down in response to deactivation of said internal circuit.

7. A semiconductor device according to claim 3, wherein said control circuit includes a fifth connecting circuit connected between input electrodes of said fourth and fifth transistors and the line of said external ground potential and conducting in response to deactivation of said internal circuit for forcing said fourth and fifth transistors to be shut down.

* * * * *